US009850087B2

(12) United States Patent
Wang

(10) Patent No.: US 9,850,087 B2
(45) Date of Patent: Dec. 26, 2017

(54) SHEET PROCESSING APPARATUS AND IMAGE FORMING SYSTEM

(71) Applicant: Konica Minolta, Inc., Chiyoda-ku, Tokyo (JP)

(72) Inventor: Shuanglong Wang, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/986,094

(22) Filed: Dec. 31, 2015

(65) Prior Publication Data

US 2016/0200534 A1 Jul. 14, 2016

(30) Foreign Application Priority Data

Jan. 9, 2015 (JP) ..... 2015-003122

(51) Int. Cl.
*B65H 7/20* (2006.01)
*B65H 5/02* (2006.01)
(Continued)

(52) U.S. Cl.
CPC ..... *B65H 7/20* (2013.01); *B65H 5/023* (2013.01); *B65H 29/12* (2013.01);
(Continued)

(58) Field of Classification Search
CPC ..... B65H 5/023; B65H 29/12; B65H 2301/44316; B65H 2301/5121; B65H 2301/5142; B65H 2404/261; B65H 2406/20; B65H 2511/17; B65H 2515/805; B65H 2301/1321; B65H 2301/51256; B65H 2515/112; B65H 2801/27;
(Continued)

(56) References Cited

U.S. PATENT DOCUMENTS 5,201,514 A * 4/1993 Rebres ..... B65H 29/70 162/271
5,414,503 A * 5/1995 Siegel ..... B65H 29/12 162/197
(Continued)

FOREIGN PATENT DOCUMENTS

JP 05-341601 A 12/1993
JP 6-83364 A 10/1994
(Continued)

OTHER PUBLICATIONS

Japanese Office Action dated Feb. 14, 2017 issued in corresponding Japanese Patent Appln. No. 2015-003122, with English translation (7 pages).

*Primary Examiner* — David H Bollinger
(74) *Attorney, Agent, or Firm* — Buchanan Ingersoll & Rooney PC

(57) ABSTRACT

A sheet processing apparatus includes a pair of belts, a water supplying unit, a curving unit and a controller. The pair of belts defines a conveying path for holding and conveying a paper sheet. The water supplying unit supplies water to outer surfaces of the belts. The curving unit curves the conveying path defined by the belts. The controller makes the water supplying unit supply water to the outer surfaces of the belts, and makes the belts convey the sheet between the belts in a state where the conveying path is curved by the curving unit to correct the curling of the sheet.

11 Claims, 9 Drawing Sheets

(51) Int. Cl.
*B65H 29/12* (2006.01)
*G03G 15/00* (2006.01)

(52) U.S. Cl.
CPC . *G03G 15/6576* (2013.01); *B65H 2301/1321* (2013.01); *B65H 2301/517* (2013.01); *B65H 2301/5142* (2013.01); *B65H 2301/51256* (2013.01); *B65H 2404/2613* (2013.01); *B65H 2406/20* (2013.01); *B65H 2406/21* (2013.01); *B65H 2515/112* (2013.01); *B65H 2801/27* (2013.01); *G03G 2215/0067* (2013.01); *G03G 2221/1696* (2013.01)

(58) Field of Classification Search
CPC ..... B65H 2301/517; G03G 15/6576; G03G 2221/1696; G03G 2215/0067
USPC ..... 271/188; 399/407, 341, 390
See application file for complete search history.

(56) References Cited

U.S. PATENT DOCUMENTS 5,539,511 A * 7/1996 Wenthe, Jr. ..... B65H 29/12 162/270
5,580,044 A * 12/1996 Wafler ..... B65H 29/12 198/840
8,265,541 B2 * 9/2012 Kougami ..... G03G 15/6576 271/188
2007/0048048 A1 * 3/2007 Kougami ..... G03G 15/6576 399/341
2007/0280765 A1 * 12/2007 Shida ..... B65H 29/70 399/406
2008/0089728 A1 * 4/2008 Kougami ..... G03G 15/6573 399/406
2009/0003912 A1 * 1/2009 Nagasaki ..... G03G 15/6576 399/406
2011/0116852 A1 * 5/2011 Ogushi ..... G03G 15/6576 399/341
2011/0121086 A1 * 5/2011 Kougami ..... G03G 15/6573 236/44 A
2015/0115527 A1 * 4/2015 Takematsu ..... G03G 15/6576 271/265.01

FOREIGN PATENT DOCUMENTS

JP 08-175732 A 7/1996
JP 2009-107795 A 5/2009
JP 2014-191311 A 10/2014
WO 2014/069307 A1 5/2014

* cited by examiner

FIG. 6

T1

| TYPE | COVERAGE RATE | WATER AMOUNT ($ml/cm^2$) |
|---|---|---|
| THIN PAPER (~60g/$m^2$) | SMALL (0~20%) | 0.56 |
| | MEDIUM (21~80%) | 0.75 |
| | LARGE (81~100%) | 0.93 |
| PLAIN PAPER (61~200g/$m^2$) | SMALL | 0.75 |
| | MEDIUM | 1 |
| | LARGE | 1.25 |
| THICK PAPER (201~g/$m^2$) | SMALL | 0.93 |
| | MEDIUM | 1.25 |
| | LARGE | 1.56 |
| COATED PAPER | – | – |

WATER AMOUNT TO BE ADDED TO FRONT SIDE
< WATER AMOUNT TO BE ADDED TO BACK SIDE

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

In an electrophotographic image forming apparatus, when an image forming process includes a step of heating paper sheets, such as a fixing step, water evaporates from the heated sheets and causes an uneven distribution on the moisture content on the sheet, which may cause curling of the sheet such as waving.

A sheet processing apparatus is known that humidifies a sheet with an image formed thereon and passes the sheet through waving uneven parts to correct the curling of the sheet (For example, Japanese Patent Laid-Open Publication No. 2010-1089).

FIG. 9 illustrates an example of such a sheet processing apparatus 500 in this structure.

The sheet processing apparatus 500 includes, for example, a receiver 510 receiving a sheet from an image forming apparatus (not shown), a humidifier 520 humidifying the sheet, a decurler 530 having uneven parts 10, 20, 30 applying a pressing force to the sheet being conveyed, an ejector 540 discharging the sheet to the exterior of the apparatus, a first conveyor 550 conveying the sheet from the humidifier 520 to the decurler 530, and a second conveyor 560 conveying the sheet from the decurler 530 to the ejector 540.

However, such a sheet processing apparatus has a conveying path having a certain length between the humidifier 520 and the decurler 530. Some of a proper amount of water added to the sheet at the humidifier 520 evaporates from the sheet passing through the conveying path. As a result, the moisture content of the sheet may become improper at the decurler 530, which may preclude a desired decurling performance.

SUMMARY OF THE INVENTION

The present invention has been made to solve the above problem of the conventional technology. An object of the present invention is to provide a sheet processing apparatus and an image forming system that achieves a stable decurling performance.

To achieve the object described above, according to an aspect of the present invention, there is provided a sheet processing apparatus, including:

a pair of belts defining a conveying path for holding and conveying a paper sheet;

a water supplying unit which supplies water to outer surfaces of the belts;

a curving unit which curves the conveying path defined by the belts; and a controller which makes the water supplying unit supply water to the outer surfaces of the belts, and makes the belts convey the sheet between the belts in a state where the conveying path is curved by the curving unit to correct the curling of the sheet.

According to another aspect of the present invention, there is provided an image forming system, including:

an image forming apparatus which forms an image on a paper sheet; and the sheet processing apparatus conveying the sheet having the image thereon which is formed by the image forming apparatus and thereby correcting the curling of the sheet.

BRIEF DESCRIPTION OF THE DRAWINGS

The present invention will be fully understood with reference to the detailed description below and the accompanying drawings. It should be noted that the detailed description and accompanying drawings are not intended to limit the present invention, and wherein:

FIG. 6 is a table for determining sheet conditions;

DESCRIPTION OF THE PREFERRED EMBODIMENTS

Embodiments of the present invention will be described below with reference to the accompanying drawings. It should be noted that the scope of the invention is not limited to the examples illustrated by the drawings.

[Image Forming System]

Figure 1:
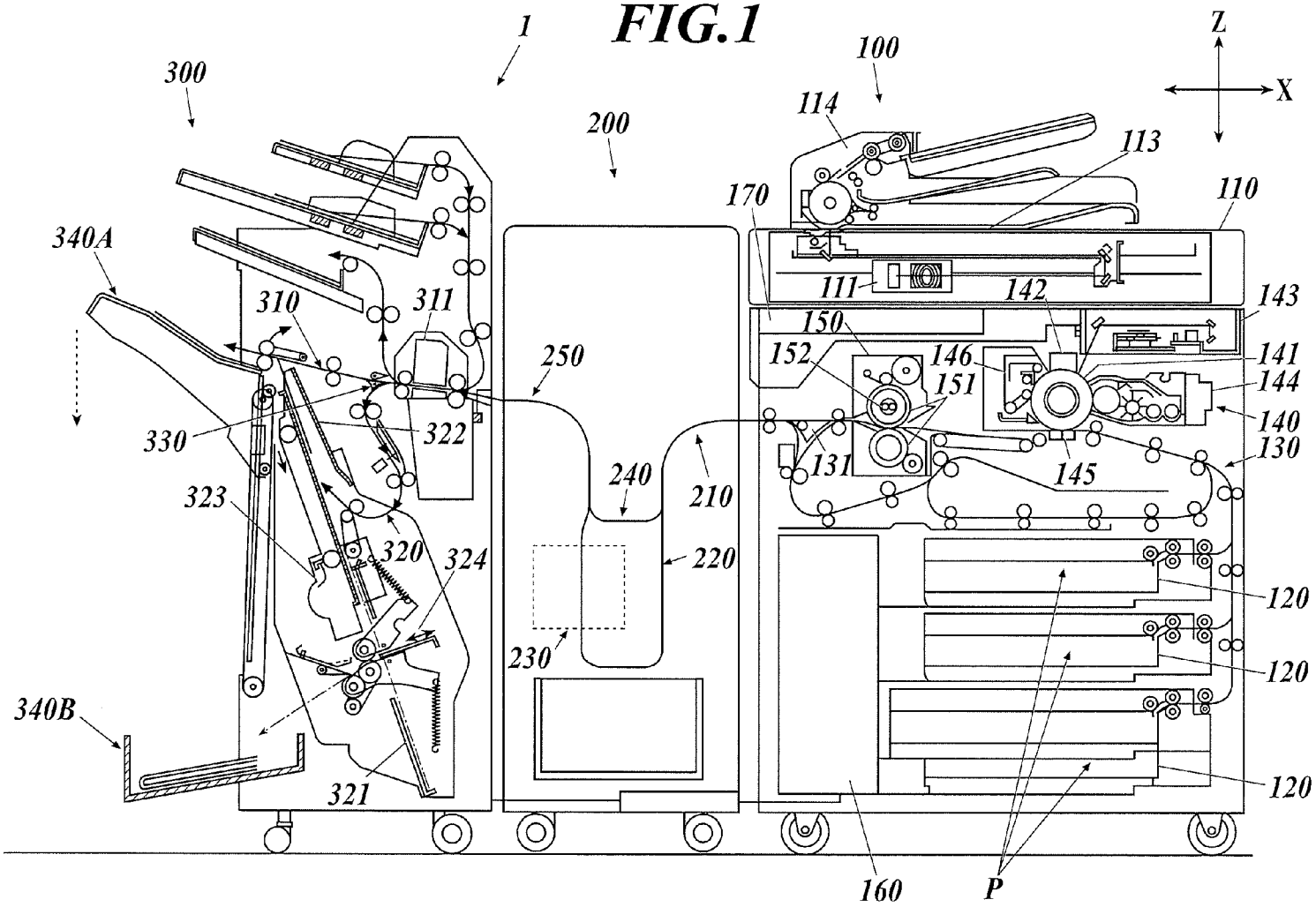
FIG. 1 is a schematic diagram illustrating the entire structure of an image forming system.
Figure 2:
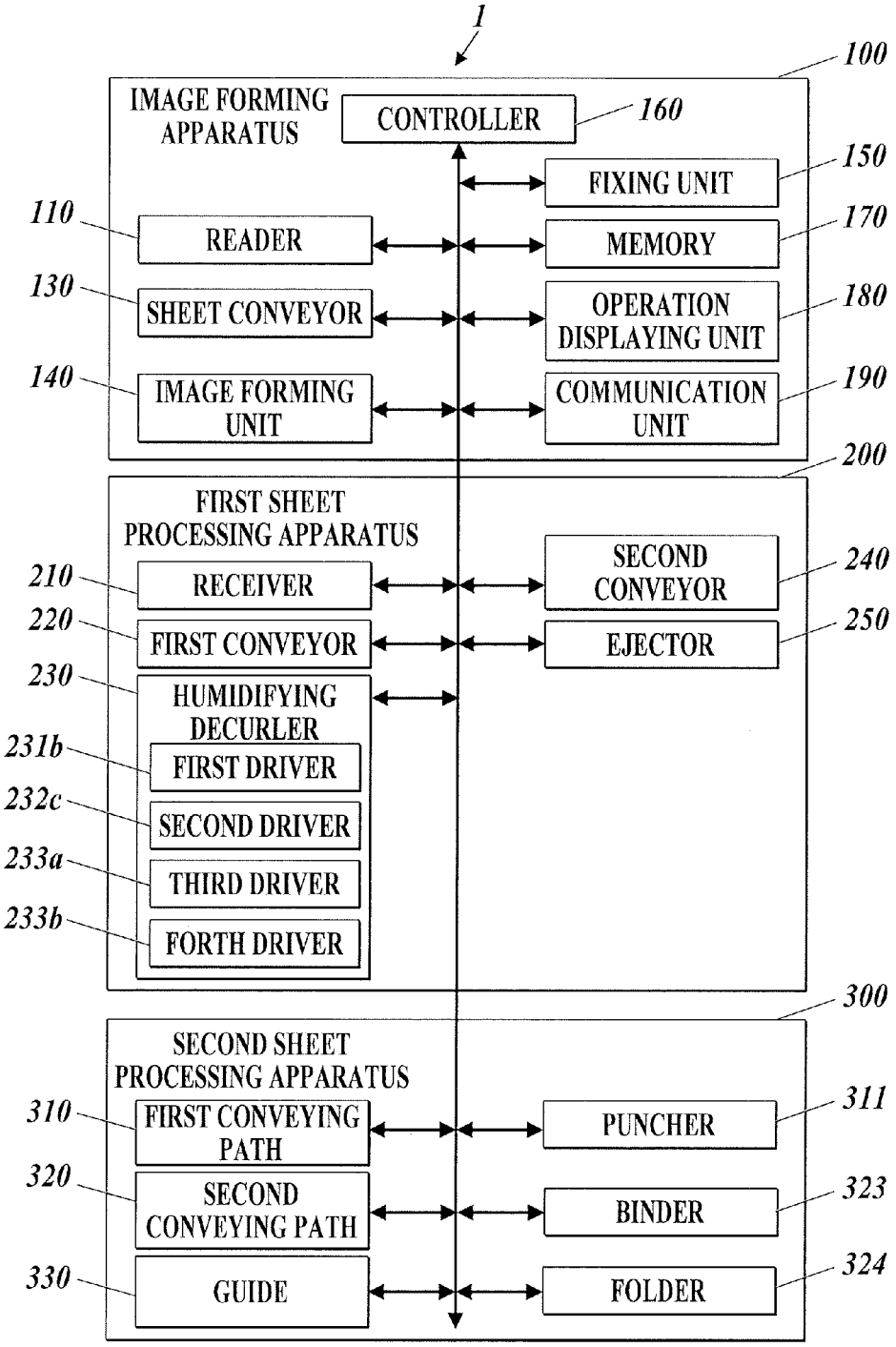
FIG. 2 is a block diagram illustrating the main structure for controlling operation of the image forming system.

FIG. 1 is a schematic diagram illustrating the entire structure of an image forming system 1 of one embodiment. FIG. 2 is a block diagram illustrating the main structure for controlling operation of the image forming system 1.

As shown in FIGS. 1 and 2, the image forming system 1 includes an image forming apparatus 100, a first sheet processing apparatus 200, and a second sheet processing apparatus 300.

The image forming apparatus 100 forms an image on a sheet P.

The first sheet processing apparatus 200 performs a humidifying and decurling process to humidify the sheet P on which an image has been formed at the image forming apparatus 100, and to correct (decurl) the curling of the sheet P.

The second sheet processing apparatus 300 performs a punching process, a binding process, or a folding process on the sheets P on which images have been formed at the image forming apparatus 100.

In the following description, the direction X indicates the coupling direction of the image forming apparatus 100, the first sheet processing apparatus 200, and the second sheet processing apparatus 300, the direction Z indicates the vertical direction, and the direction Y indicates the direction perpendicular to the directions X and Z.

[Image Forming Apparatus}

The image forming apparatus 100 will be described first.

As shown in FIGS. 1 and 2, the image forming apparatus 100 includes a reader 110, a sheet tray 120, a sheet conveyor 130, an image forming unit 140, a fixing unit 150, a controller 160, a memory 170, an operation displaying unit 180, and a communication unit 190.

The reader 110 optically reads a document and generates image data.

Specifically, the reader 110 includes a sensing device 111 which has an image sensor such as a charge-coupled device (CCD) or a complementary metal oxide semiconductor (CMOS) image sensor, and outputs electric signals corresponding to the read image, a generator (not shown) generating image data based on the electric signals output from the sensing device 111, a platen 113 having a transparent board-shaped member on which a document can be placed, the transparent board-shaped member being disposed on a side where the sensing device 111 reads a document, and an auto document feeder (ADF) 114 conveying a document such that the document is moved with respect to the sensing device 111. The sensing device 111 reads the document placed on the platen 113. The sensing device 111 also reads the document conveyed by the auto document feeder 114.

The sheet tray 120 is a box-shaped member storing a stack of sheets P. The sheet tray 120 can be pulled out of the housing of the image forming apparatus 100 or pushed back into the housing. The sheet tray 120 stores sheets P to be processed for forming images thereon by the image forming apparatus 100. As shown in FIG. 1, the image forming apparatus 100 includes a plurality of sheet trays 120, each of which stores sheets P of a different size. These sheet trays 120 may store sheets P of the same size.

The sheet conveyor 130 conveys a sheet P among sections such as the sheet tray 120, the image forming unit 140 and the fixing unit 150.

Specifically, the sheet conveyor 130 includes a plurality of rollers disposed at intervals along the sheet conveying path disposed between or in the vicinity of sections such as the sheet tray 120, the image forming unit 140, and the fixing unit 150, and driving units (not shown) driving these rollers. The sheet conveyor 130 draws sheets P stored in the sheet tray 120 one by one, and conveys them to the image forming unit 140. After the image forming unit 140 forms an image on the sheet P, the sheet conveyor 130 conveys the sheet P with the image formed thereon to the fixing unit 150. After the fixing unit 150 fixes the image onto the sheet P, the sheet conveyor 130 conveys the sheet P with the image fixed thereon to an ejector disposed on the side of the first sheet processing apparatus 200. The sheet P is then discharged from the ejector. In printing on both sides of a sheet P, the sheet conveyor 130 conveys the sheet P to a turning point 131 disposed on the conveying path between the fixing unit 150 and the ejector. At the turning point 131, the sheet P is flipped over. The sheet conveyor 130 then conveys the sheet P back to the image forming unit 140.

The image forming unit 140 forms an image on a sheet P.

Specifically, the image forming unit 140 includes a photoconductor 141 the outer surface of which comes into contact with a sheet P being conveyed by the sheet conveyor 130, a charging unit 142 electrifying the photoconductor 141, an exposing unit 143 exposing the electrified photoconductor 141 to light based on the image data, a developing unit 144 forming a toner image on the photoconductor 141 corresponding to the image data (a primary transfer), a transfer unit 145 transferring the toner image on the photoconductor 141 to the sheet P (a secondary transfer), and a cleaner 146 removing the toner remaining on the photoconductor 141. The image forming unit 140 of the present embodiment has such a structure for forming an electrophotographic image. This is merely an example and not limitative. The image forming unit 140 may have any other structure for forming an image in any other image forming mechanism such as ink-jet.

The image forming unit 140 shown in FIG. 1 includes the single developing unit 144 and forms a monochromatic image. This is merely an example and not limitative. The image forming unit 140 may include developing units 144 for different colors such as cyan (C), magenta (M), yellow (Y), and black (K), and form a multicolor image by combining these colors.

The fixing unit 150 fixes an image formed on a sheet P by the image forming unit 140.

Specifically, the fixing unit 150 includes a pair of fixing rollers 151, 151 the outer surfaces of which are in contact with each other so as to sandwich the conveying path for a sheet P, and a heater 152 heating one of the fixing rollers 151, 151, which is on the image side of the sheet P which is formed by the image forming unit 140 (the upper side in FIG. 1, for example). In the fixing unit 150, the rotating fixing rollers 151, 151 hold and convey a sheet P while the roller heated by the heater 152 heats the image side of the sheet P. As a result, the toner image transferred on the sheet P is fixed on the sheet P.

The controller 160 performs an overall control of the individual apparatuses of the image forming system 1 and the individual units of each of these apparatuses in response to instructions inputted via the operation displaying unit 180 or the communication unit 190. The controller 160 includes a central processing unit (CPU) and a random access memory (RAM). The CPU reads the programs stored in the memory 170, expands them in a work area in the RAM, and performs various processes in cooperation with the programs.

For example, the controller 160 controls the image forming apparatus 100 to form an image on a sheet P based on image data sent from the reader 110.

The controller 160 also controls the first sheet processing apparatus 200 to humidify and decurl the sheet P based on preset sheet conditions.

The controller 160 also controls the second sheet processing apparatus 300 to perform a predetermined process on the sheet P based on the preset setting conditions.

Although, the image forming apparatus 100 includes the controller 160 which performs the overall control of the image forming system 1 in the present embodiment, each of the image forming apparatus 100, the first sheet processing apparatus 200, and the second sheet processing apparatus 300 may include a controller controlling the corresponding apparatus and communicating with the other apparatuses.

The memory 170 stores programs to be executed by the controller 160 and data necessary for execution of the programs.

For example, the memory 170 stores sheet conditions for controlling a humidifying and decurling process performed by the humidifying decurler 230 of the first sheet processing apparatus 200. When a user sets sheet conditions via the operation displaying unit 180, the memory 170 stores the set sheet conditions. The sheet conditions will be described in detail later.

In addition, the memory 170 stores settings on sheet processing at the second sheet processing apparatus 300.

The operation displaying unit 180 displays various types of information on the operation of the image forming system 1. The operation displaying unit 180 includes a touch panel detecting various input operations by a user in response to displayed content, and a plurality of switches for various input operations by the user. The controller 160 performs a process for controlling displayed contents on the touch panel of the operation displaying unit 180. The controller 160 also controls the operation of the image forming system 1 based on various input operations by the user via the operation displaying unit 180.

The operation displaying unit 180 is used, for example, for inputting sheet conditions on a humidifying and decurling process performed by the humidifying decurler 230 of the first sheet processing apparatus 200.

The communication unit 190 includes a network interface card (NIC) or an equivalent structure, and establishes communication between the image forming system 1 and other computers. When a print job including image data is input via the communication unit 190, the controller 160 forms an image based on the print job.

After the image forming apparatus 100 ejects a sheet P, the sheet P is conveyed to the first sheet processing apparatus 200.

[First Sheet Processing Apparatus]

The first sheet processing apparatus 200 will be described next.

Figure 3:
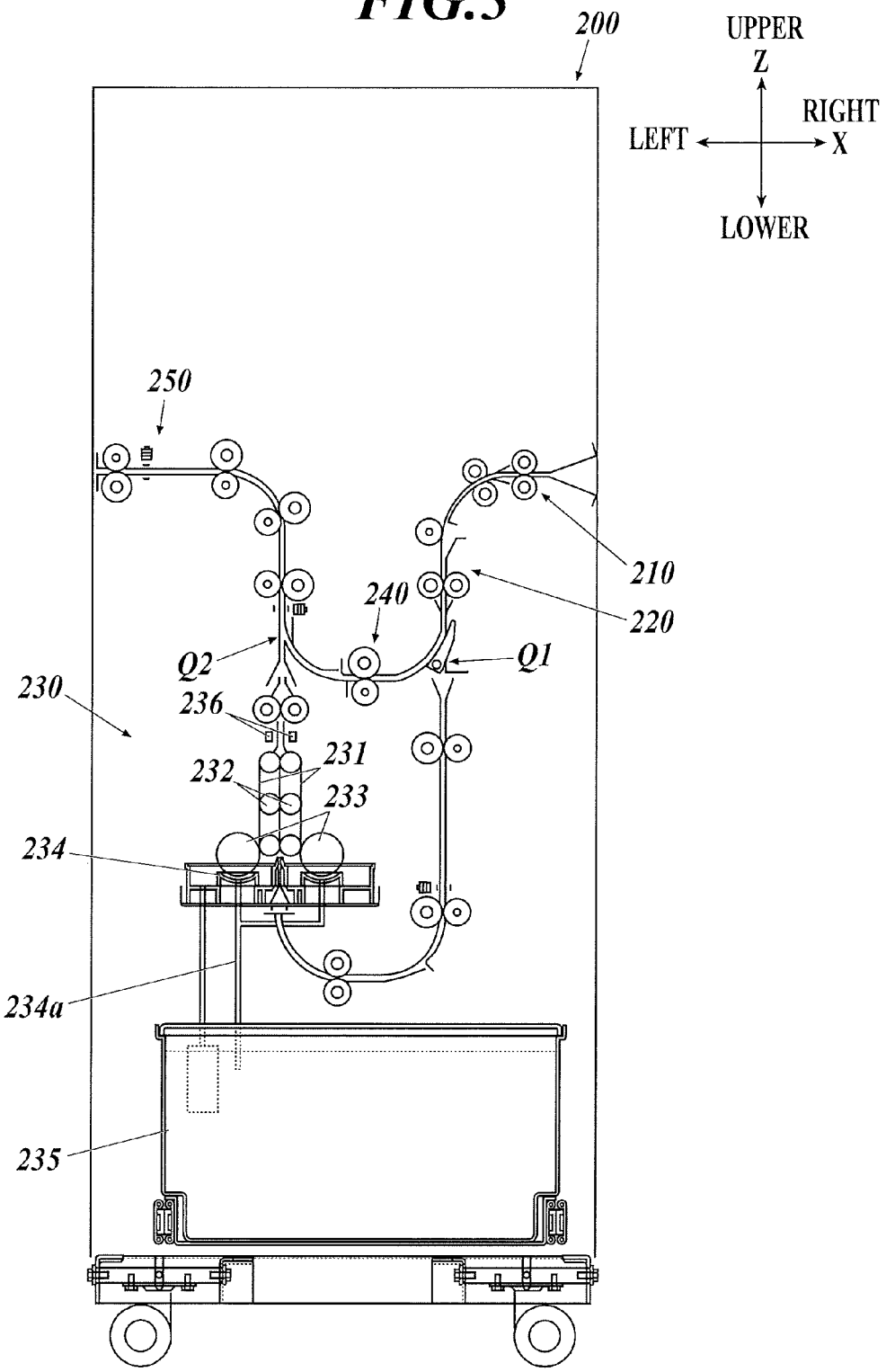
FIG. 3 illustrates the main structure of a first sheet processing apparatus.

FIG. 3 illustrates the main structure of the first sheet processing apparatus 200.

As shown in FIGS. 2 and 3, the first sheet processing apparatus 200 includes a receiver 210, a first conveyor 220, a humidifying decurler 230, a second conveyor 240, and an ejector 250.

In the following description, the direction X has a right side and a left side, and the direction Z has an upper side and a lower side. The right side of the first sheet processing apparatus 200 is adjacent to the image forming apparatus 100. The left side of the first sheet processing apparatus 200 is adjacent to the second sheet processing apparatus 300. The upper side of the first sheet processing apparatus 200 is on the side of the ejector 250. The lower side of the first sheet processing apparatus 200 is on the side of the humidifying decurler 230.

The receiver 210 receives a sheet P discharged from the image forming apparatus 100, and feeds the sheet P to the interior of the first sheet processing apparatus 200.

The first conveyor 220 conveys the sheet P fed into the first sheet processing apparatus 200, through the receiver 210, to the humidifying decurler 230 disposed below the receiver 210. The first conveyor 220 includes a branch point Q1 at which the conveying path is branched to introduce the sheet P to the second conveyor 240.

Figure 4:
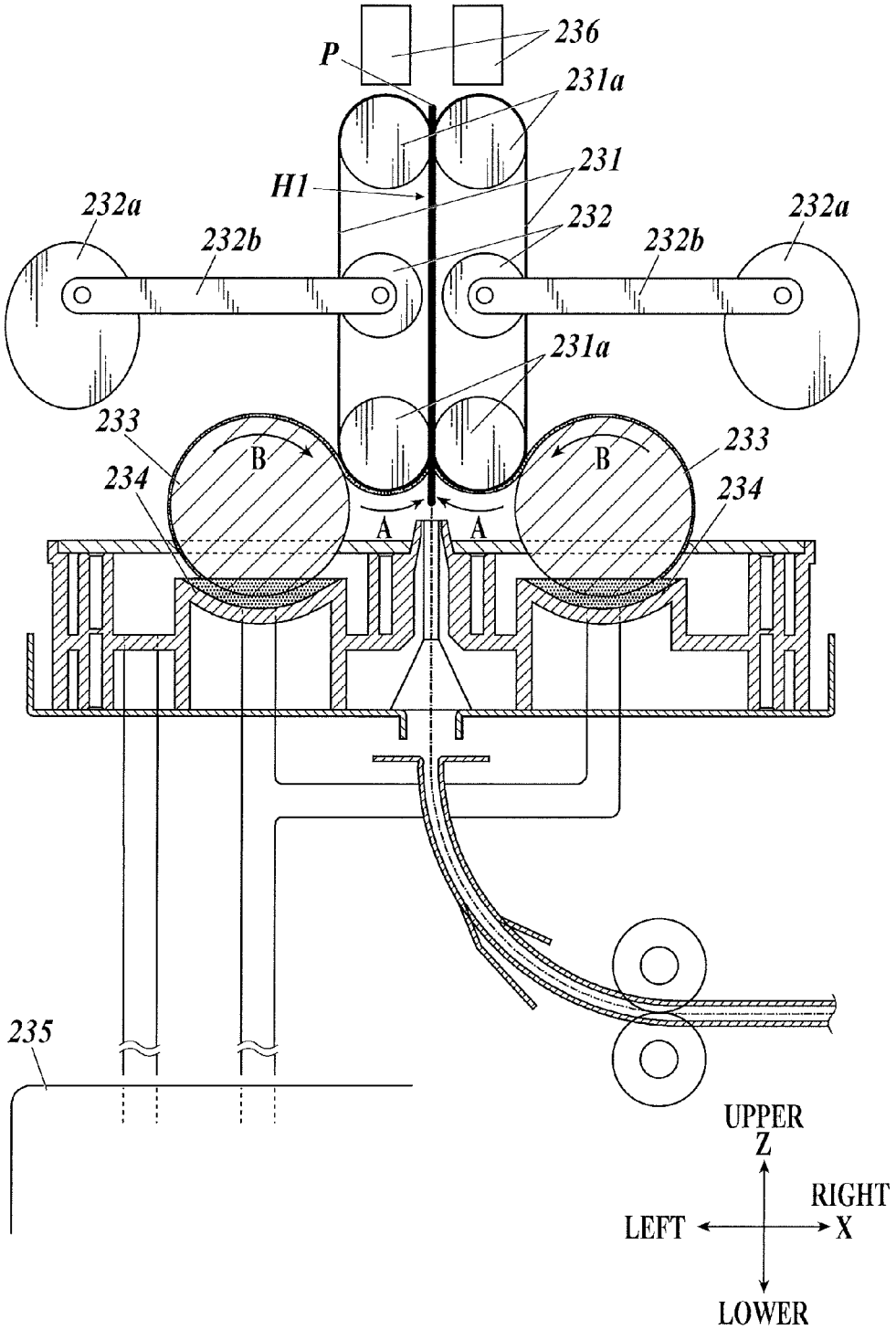
FIG. 4 is an enlarged diagram of an essential part illustrating the structure of a humidifying decurler.

FIG. 4 is an enlarged diagram of an essential part illustrating the structure of the humidifying decurler 230.

The humidifying decurler 230 is a mechanism that humidifies the sheet P conveyed by the first conveyor 220 and corrects (decurls) the curling of the sheet P.

The humidifying decurler 230 includes a pair of humidifying belts 231, 231, pressing rollers 232, 232 pressing and curving the humidifying belts 231, 231, water supplying rollers 233, 233 supplying water to the humidifying belts 231, 231, storages 234, 234 storing water to be supplied to the water supplying rollers 233, 233, a tank 235 storing water, and fans 236, 236 blowing air on a sheet P downstream of the humidifying belts 231, 231.

Each of the humidifying belts 231, 231 is stretched by two rollers 231*a*, 231*a* that are separated in a predetermined distance.

The right and left pairs of rollers 231*a*, 231*a* are rotated by a first driver 231*b* (see FIG. 2) in the opposite directions to each other as shown by the arrows A in FIG. 4. The rotation of the pairs of rollers 231*a*, 231*a* allows the humidifying belts 231, 231 to hold and convey a sheet P.

The humidifying belts 231, 231 are composed of hydrophilic elastic material, such as rubber. The humidifying belts 231, 231 can retain water on their outer surfaces and are elastically deformable.

The rotating humidifying belts 231, 231 retaining water hold the sheet P and convey it downstream while humidifying the sheet P.

Each of the pressing rollers 232, 232 (a curving unit) is disposed in the middle of the inside of the corresponding humidifying belt 231.

Each of the pressing rollers 232 is provided with a connector bar 232*b* coupled to the pressing roller 232 at one end and to an eccentric cam 232*a* at the other end.

The eccentric cam 232*a* is rotated clockwise or counterclockwise by a predetermined angle with a second driver 232*c* (see FIG. 2). The rotation of the eccentric cam 232*a* moves the connector bar 232*b*, which allows the pressing roller 232 to press the middle of the humidifying belt 231 and curve the humidifying belt 231 rightward or leftward.

Figure 5A:
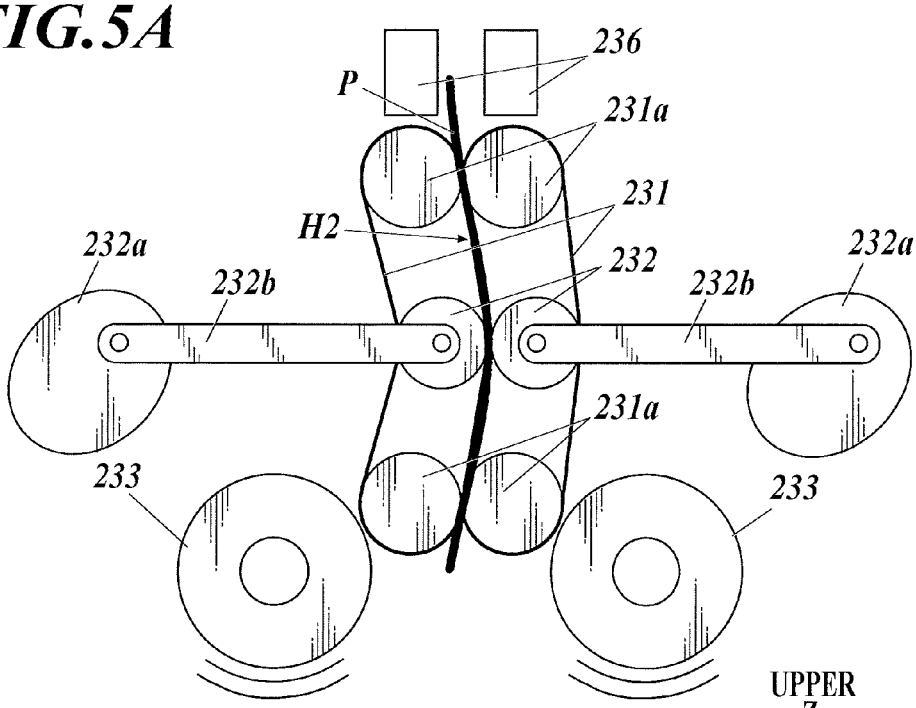
FIG. 5A is a schematic diagram explaining the operation of the humidifying decurler.
Figure 5A:
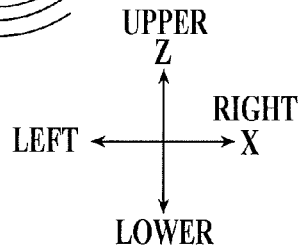
Figure 5B:
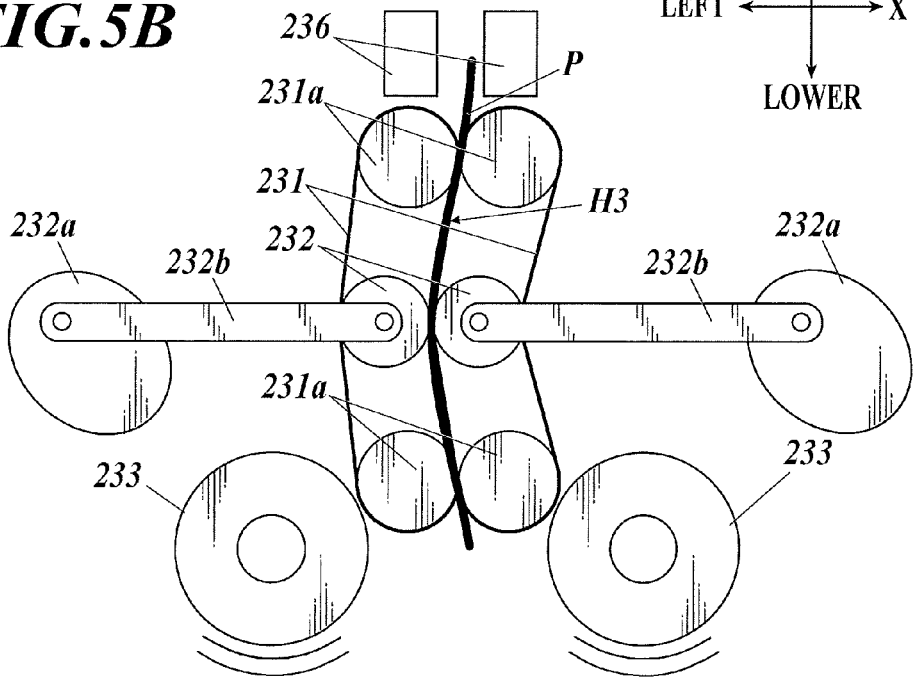
FIG. 5B is a schematic diagram explaining the operation of the humidifying decurler.

FIGS. 5A and 5B illustrate the humidifying belts 231, 231 being pressed and curved by the pressing rollers 232, 232.

FIG. 5A illustrates the humidifying belts 231, 231, which are bent or protrude to the right, and FIG. 5B illustrates the humidifying belts 231, 231, which are bent or protrude to the left.

As shown in FIG. 5A, the clockwise rotation of the eccentric cam 232*a* moves the connector bar 232*b* rightward, which deforms the conveying path defined by the humidifying belts 231, 231 from a liner conveying path H1 (FIG. 4) to a rightward curved conveying path H2 (FIG. 5A).

As shown in FIG. 5B, the couterclockwise rotation of the eccentric cam 232*a* moves the connector bar 232*b* leftward, which deforms the conveying path defined by the humidifying belts 231, 231 from the liner conveying path H1 (FIG. 4) to a leftward curved conveying path H3 (FIG. 5B).

The conveying path H1 (FIG. 4) is a conveying path for the case where the correction of the curling of a sheet P is not necessary. The conveying path H2 (FIG. 5A) is a conveying path for the correction of the leftward curling of a sheet P. The conveying path H3 (FIG. 5B) is a conveying path for the correction of the rightward curling of a sheet P.

Through the conveying path H1, the conveying path H2, or the conveying path H3, a sheet P is conveyed downstream.

The water supplying rollers 233, 233 (a water supplying unit) are provided for the respective humidifying belts 231, 231.

The water supplying rollers 233, 233 are rotated in the opposite directions to each other by a fourth driver 233*b* (see FIG. 2) as shown by the arrows B in FIG. 4. Each of the water supplying rollers 233, 233 rotates while being in contact with the outer surface of the humidifying belt 231 and water stored in the storage 234. The water supplying roller 233 thus can retain water from the storage 234 on its outer surface to supply water to the humidifying belt 231.

The water supplying rollers 233, 233 can be brought into or out of contact with the humidifying belts 231, 231 by a third driver 233*a* (see FIG. 2). This allows the water supplying rollers 233, 233 to adjust the pressing force applied to the humidifying belts 231, 231, thereby adjusting the amount of water supplied to the humidifying belts 231, 231.

The storage 234 has a convex bottom surface that conforms to the outer surface of the water supplying roller 233, and stores water on the convex bottom surface. Part of the outer surface of the water supplying roller 233 is kept below the surface of water stored in the storage 234 and is out of contact with the convex bottom surface of the storage 234. This allows the rotating water supplying roller 233 to soak in the water stored in the storage 234 and retain the water on its outer surface. The storage 234 is coupled to the tank 235 below with a delivering path 234*a*.

The tank 235 is a container storing water. Water in the tank 235 is delivered by a pump (not shown) via the delivering path 234*a* to the storages 234. This allows the storages 234 to store a proper volume of water.

The fans 236, 236 (a drying unit) are disposed on both sides of the sheet conveying path downstream of the humidifying belts 231, 231. The fans 236, 236 blow air against both sides of a sheet P immediately after the release from the humidifying belts 231, 231 to dry the sheet P.

The fans 236, 236 dry the sheet P conveyed in a humidified state. The dried sheet P will thus not be curled again even if the sheet P passes through a curved conveying path downstream of the humidifying belts 231, 231 (and the fans 236, 236).

In the present embodiment, the humidifying decurler 230 described above humidifies a sheet P and corrects (decurls) the curling of the sheet P under the control of the controller 160 based on the sheet conditions stored in the memory 170. The humidifying and decurling process will be described in detail later.

Referring back to FIG. 3, the second conveyor 240 conveys the sheet P fed to the interior of the first sheet processing apparatus 200 through the receiver 210, bypassing the humidifying decurler 230, downstream of the humidifying decurler 230. In other words, the second conveyor 240 conveys the sheet P conveyed via the branch point Q1 of the first conveyor 220, bypassing the humidifying decurler 230, to a junction point Q2 disposed downstream of the humidifying decurler 230.

The ejector 250 discharges the sheet P conveyed from the humidifying decurler 230 or the second conveyor 240, to the second sheet processing apparatus 300 disposed on the outside of the first sheet processing apparatus 200.

The first sheet processing apparatus 200 may include any other structure such as a cooling and conveying path cooling a sheet P other than the structures of the units described above.

The humidifying and decurling process performed by the humidifying decurler 230 of the first sheet processing apparatus 200 will be described now.

FIG. 6 is an example of a setting table for determining sheet conditions.

As shown in FIG. 6, a setting table T1 includes the sheet conditions on the types of sheets P (thin, plain, thick, and coated) and their coverage rates (small, medium, and large), and the amounts of water per unit area to be added to the sheets P based on the combinations of the sheet types and the coverage rates. In the setting table T1 of FIG. 6, the coverage rate indicates the rate of the printed area to the area on both sides of a sheet. The same amount of water is set so as to be added to both sides of the sheet P. The setting table T1 does not include the amounts of water for sheets not subject to the humidifying and decurling process.

As shown in FIG. 6, a sheet with a larger coverage rate requires a larger amount of water if the sheet type is the same. At a larger coverage rate, toner on the sheet surface precludes the precise correction of the curling of the sheet. Therefore, a larger amount of water for humidifying is set for a sheet with a larger coverage rate to satisfactorily correct the curling of the sheet. In addition, a thicker sheet (a sheet with a larger basis weight) requires a larger amount of water to be added to the sheet as a whole. A thicker sheet with a larger basis weight has a higher rigidity, which precludes the precise correction of the curling of the sheet. Therefore, a larger amount of water for humidifying is set for a thicker sheet with a larger basis weight to satisfactorily correct the curling of the sheet. The amounts of water shown in FIG. 6 are merely examples and may be changed appropriately changeable.

Figure 7:
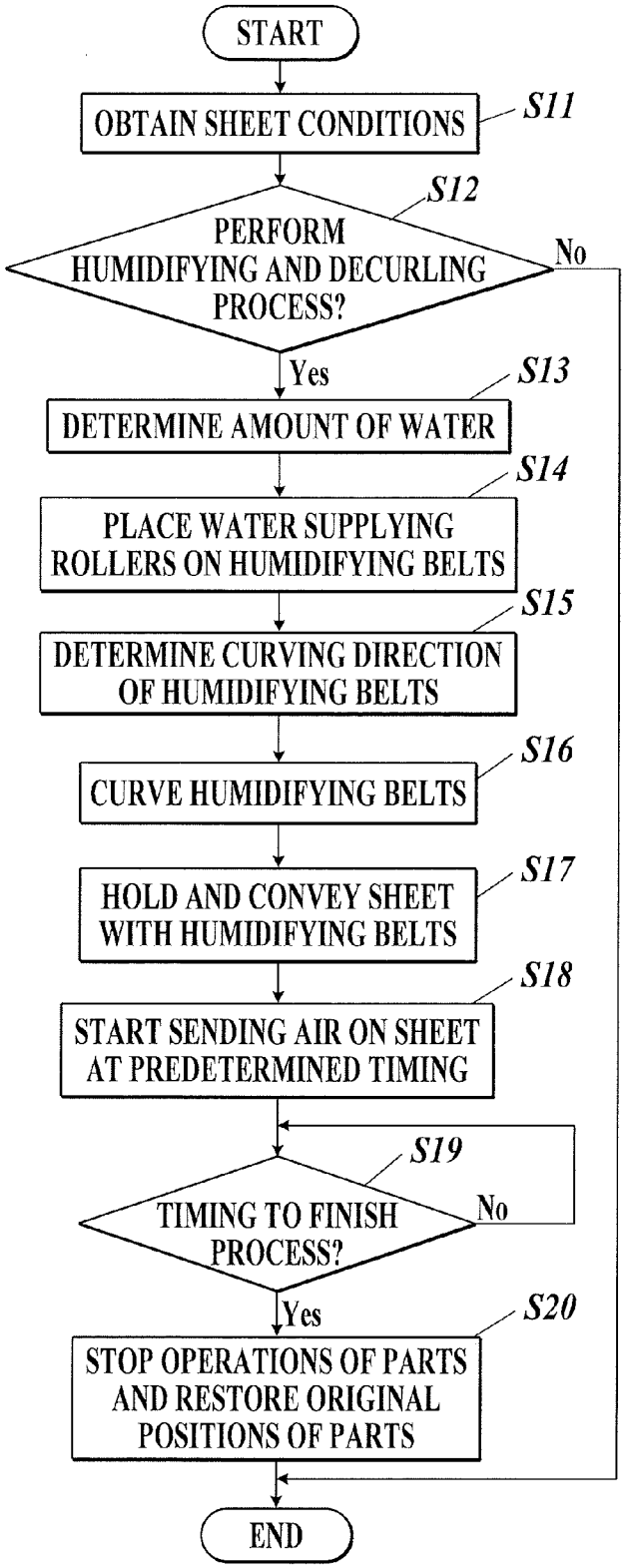
FIG. 7 is a flow chart illustrating a humidifying and decurling process performed by the humidifying decurler.

FIG. 7 is a flow chart illustrating the humidifying and decurling process performed by the humidifying decurler 230. As a premise, the sheet P is conveyed at a constant speed.

Figure 8:
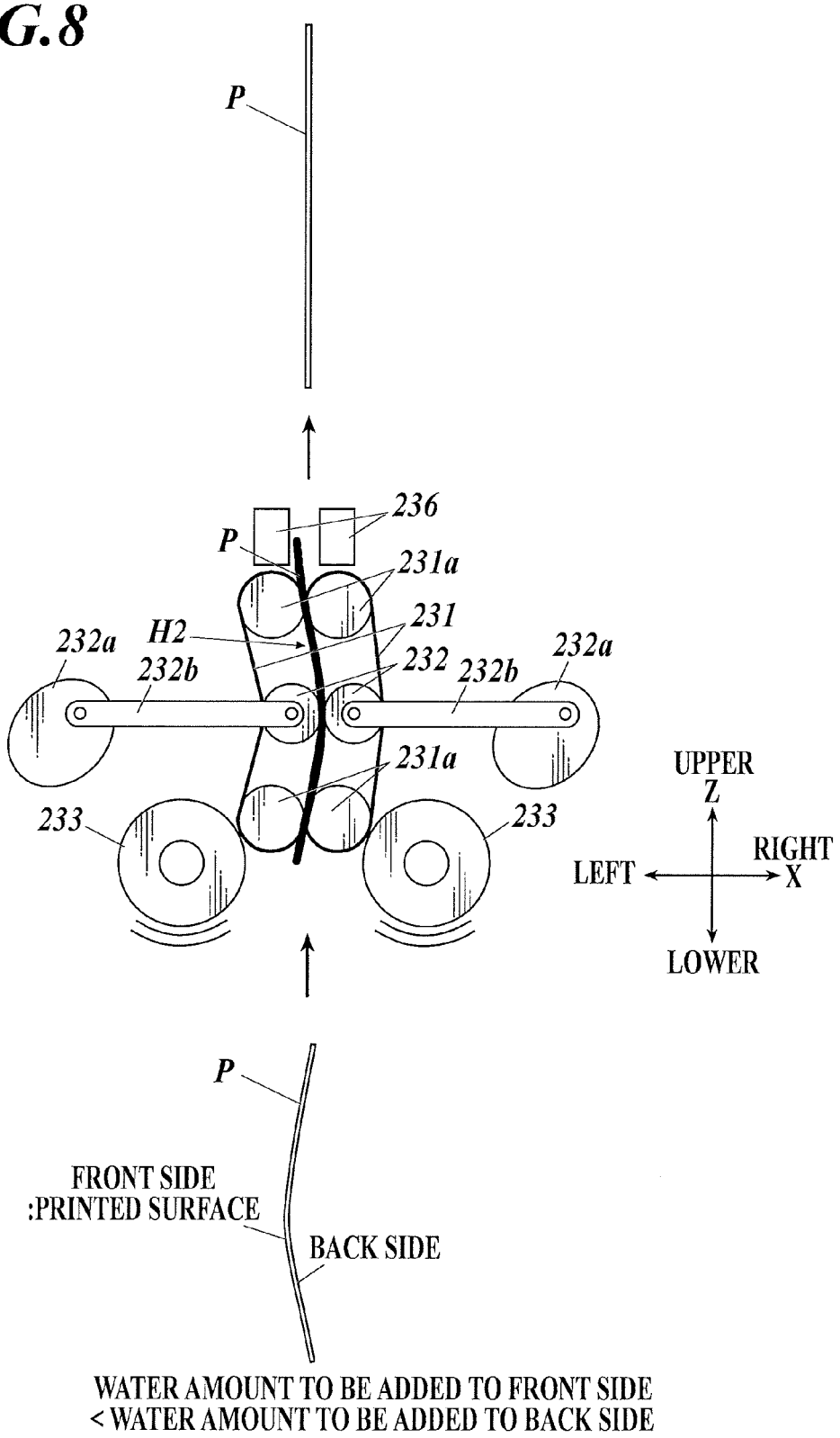
FIG. 8 explains the state of a humidified and decurled sheet.
Figure 9:
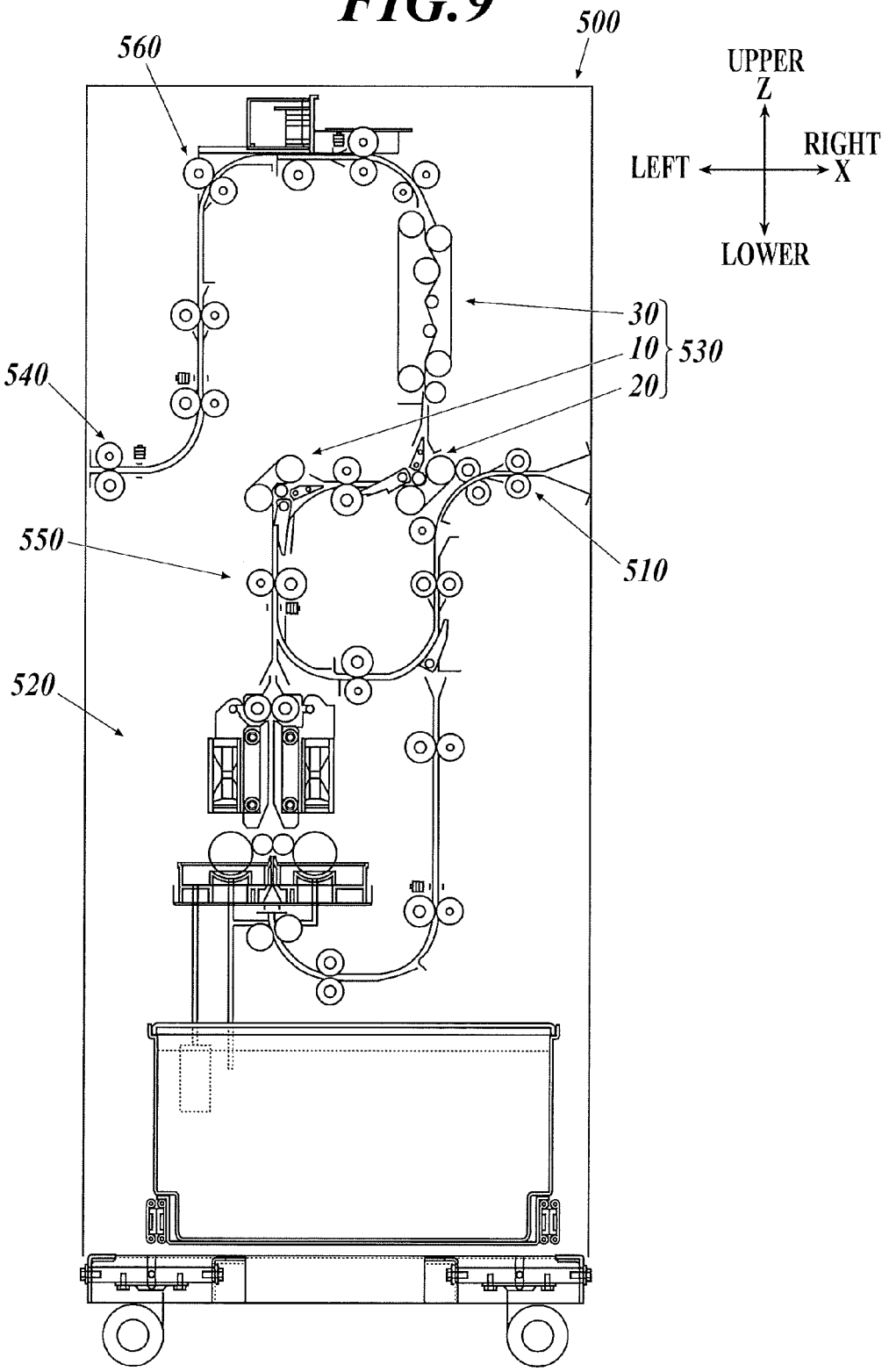
FIG. 9 explains a conventional sheet processing apparatus.

FIG. 8 illustrates an example of change of a sheet P due to the humidifying and decurling process. FIG. 8 illustrates the sheet P the front side of which is printed and curled outward.

The controller 160 obtains the sheet conditions (the type of the sheet P and its coverage rate) included in the job information (Step S11).

The controller 160 then refers to the setting table T1 (FIG. 6) stored in the memory 170 and determines whether the type of sheet P included in the obtained sheet conditions falls under the types of sheet for which the humidifying and decurling process is performed, and thereby determining whether the humidifying and decurling process should be performed or not (Step S12).

If the controller 160 determines that the humidifying and decurling process does not need to be performed (Step S12: NO), the controller 160 ends the process.

If the controller 160 determines that the humidifying and decurling process needs to be performed (Step S12: YES), the controller 160 determines the amount of water to be supplied to the sheet P (Step S13).

Specifically, the controller 160 refers to the setting table T1 (FIG. 6) stored in the memory 170 and determines the amount of water to be added to both sides of the sheet P based on the sheet type and coverage rate in the obtained sheet conditions.

Based on the determined water amount, the pressing force of the water supplying rollers 233, 233 to be applied to the humidifying belts 231, 231 is determined. Specifically, if the amount of water to be added to the sheet is large, the pressing force of the water supplying roller 233, 233 to be applied to the humidifying belts 231, 231 is determined to be high. The detailed relationships between the amounts of water to be added to the sheet and the pressing forces of the water supplying rollers 233, 233 to be applied to the humidifying belts 231, 231 are determined by experiments or simulations.

The controller 160 then controls the third driver 233*a* to drive the water supplying rollers 233, 233 such that the water supplying rollers 233, 233 come into contact with the humidifying belts 231, 231 under the pressing force which supplies the amount of water determined at Step S13 (Step S14).

The controller 160 then determines the curving direction of the humidifying belts 231, 231 based on the sheet conditions obtained at Step S11 (Step S15).

Specifically, the controller 160 determines the curving direction of the humidifying belts 231, 231 such that the conveying path is curved in the direction that corrects the curling of the sheet P (the direction opposite to the curling of the sheet P). For example, the memory 170 may store a table (not shown) on the sheet types and the directions in which the sheets tend to be curled, and the controller 160 may refer to the table to determine the curving direction of the humidifying belts 231, 231, which is the direction opposite to the curling of the sheet.

In the example shown in FIG. 8, the conveying path H2 which is convex rightward is selected.

The controller 160 then controls the second driver 232*c* to rotate the eccentric cam 232*a*. The rotation of the eccentric cam 232*a* moves the connector bar 232*b*, which allows the pressing rollers 232, 232 to press and curve the humidifying belts 231, 231 in the direction determined at Step S15. As a result, the conveying path H2 or the conveying path H3 is defined (Step S16).

In the example shown in FIG. 8, the conveying path H2 which is convex rightward is defined.

The controller 160 then controls the first driver 231*b* to rotate the right and left pairs of rollers 231*a*, 231*a*, which allows the humidifying belts 231, 231 to rotate while holding and conveying the sheet P (Step S17).

As shown in FIG. 8, the humidifying belts 231, 231 hold and convey the sheet P while correcting the curling of the sheet P.

The controller 160 then controls the fans 236, 236 to blow air on the sheet P after a predetermined time, that is, when the advancing front end of the sheet P is released from the humidifying belts 231, 231 (Step S18).

The controller 160 then determines whether the humidifying and decurling process should be finished or not (Step S19). If the process should not be finished (Step S19: NO), Step S19 will be repeated.

If the process should be finished (Step S19: YES), the controller 160 controls the humidifying decurler 230 to stop the operations of their parts and restore them to the original positions (Step S20) to finish the process.

In the humidifying and decurling process described above, the curling of the sheet P is corrected immediately after the sheet P is humidified. The generally flattened sheet without the curling is conveyed downstream as shown in FIG. 8.

[Second Sheet Processing Apparatus]

Referring back to FIG. 1, the second sheet processing apparatus 300 includes a first conveying path 310, a second conveying path 320, a guide 330, and ejector trays 340A, 340B. The first conveying path 310 includes a puncher 311, for example. The second conveying path 320 includes a stacker 321, an aligner 322, a binder 323, and a folder 324.

The first conveying path 310 is called a straight path and includes a plurality of rollers, and drivers (not shown) driving the rollers to convey a sheet P.

The puncher 311 includes a punch rod and performs a punching process on a sheet P conveyed from the first sheet processing apparatus 200.

The second conveying path 320 is called a stack path and includes a plurality of rollers, and drivers (not shown) driving the rollers to convey a sheet P as in the first conveying path 310.

The stacker 321 receives sheets P from the second conveying path 320 and stores the stack of sheets P temporarily.

The aligner 322 is a pair of aligning members aligning sheets in the width direction by jogging the longitudinal edges of the sheets. The aligning members are movably disposed on both sides of the stacker 321.

The binder 323 includes a stapler and performs a binding process with staples on the stack of sheets P on the stacker 321.

The folder 324 performs a folding process on the sheets P on the stacker 321. The stack of folded sheets is discharged to the ejector tray 340B by a conveyor belt (not shown).

The guide 330 guides the conveying direction of a sheet and switches the conveying direction between the first conveying path 310 and the second conveying path 320.

The ejector tray 340A receives the stack of sheets discharged from the first conveying path 310. The ejector tray 340B receives the stack of sheets discharged from the second conveying path 320.

The structure of the second sheet processing apparatus 300 is not limited to the above structure. The second sheet processing apparatus 300 may have any other structure such as a structure for cutting sheets, for example.

As described above, the present embodiment includes the pair of humidifying belts 231, 231 defining the conveying path along which a sheet P is held and conveyed, the water supplying rollers 233, 233 supplying water to the outer surfaces of the humidifying belts 231, 231, the pressing rollers 232, 232 pressing and curving the conveying path H1 defined by the humidifying belts 231, 231, and the controller 160 controlling the water supplying rollers 233, 233 to supply water to the outer surfaces of the humidifying belts 231, 231, and controlling the humidifying belts 231, 231 to correct the curling of the sheet P by conveying the sheet P between the humidifying belts 231, 231 while the conveying path H1 is curved by the pressing rollers 232, 232.

This allows a proper amount of water to be added to the sheet P for the correction of the curling of the sheet P, which achieves a stable decurling performance.

In the humidifying and decurling process performed by the humidifying belts 231, 231, a stable holding pressure is applied to the sheet P, which keeps the amount of water to be added to the sheet P constant.

Compared with the structure of the conventional apparatus in which the humidifier and the decurler are separated, the present embodiment enables the compact structure of the apparatus that saves space.

In the present embodiment, the controller 160 determines the amount of water to be supplied to the sheet P based on the sheet conditions including the type of the sheet P and its coverage rate.

This allows a proper amount of water to be supplied to the sheet P on a sheet-by-sheet basis, which achieves a stable decurling performance.

In the present embodiment, the water supplying rollers 233, 233 are provided in contact with the respective humidifying belts 231, 231. The controller 160 adjusts the pressing force of the water supplying rollers 233, 233 applied to the humidifying belts 231, 231, thereby controlling the amount of water to be supplied to the humidifying belts 231, 231.

This enables the adjustment of the amount of water to be supplied to the humidifying belts 231, 231 without any complicate structure for adjusting the water amount.

In the present embodiment, the fans 236, 236 are disposed downstream of and in the vicinity of the humidifying belts 231, 231 to remove the moisture of the sheet P.

This allows the sheet P to be dried immediately after the release of the sheet P from the humidifying belts 231, 231, which prevents the sheet P from being curled again due to the curve of the conveying path downstream.

In the above embodiment, the controller 160 determines the same amount of water to be added to both sides of the sheet P at Step S13. However, the different amounts of water may be determined for the front side of the sheet P and the back side of the sheet P. In other words, the controller 160 may determine different amounts of water respectively for the front side and back side of the sheet, and controls the water supplying rollers 233, 233 to supply the determined amounts of water to the outer surfaces of the humidifying belts 231, 231 which correspond to the front side and back side of the sheet, respectively.

This allows proper amounts of water to be supplied respectively to the front side and back side of the sheet P, which achieves a stable decurling performance.

For example, the controller 160 may determine the amounts of water to be supplied respectively to the front side and back side of the sheet based on the coverage rates of the front side and back side of the sheet. More specifically, if the sheet has a larger coverage rate on the front side than that of the back side, the water amount for the front side of the sheet is determined to be larger than that for the back side of the sheet.

This allows proper amounts of water to be supplied respectively to the front side and back side of the sheet P based on the coverage rates of the front side and back side of the sheet P, which achieves a stable decurling performance.

In the above embodiment, the controller 160 determines the curving direction of the humidifying belts 231, 231 at Step S15 based on the sheet conditions obtained at Step S11. The controller 160 may determine the curving direction of the humidifying belts 231, 231 based on the result detected by a detector detecting the curling of the sheet P. The detector may include a plurality of sensors aligned across the conveying path defining the first conveyor 220 and in the width direction of the sheet P. The sensors face the sheet surface for detecting the distances to the sheet surface. This structure enables the detection of the curling of the sheet P based on the distances to the sheet surface detected by the sensors. Then, the controller 160 determines the curving direction of the humidifying belts 231, 231 to define the conveying path curved in the direction that corrects the curling of the sheet P (the direction opposite to the curling of the sheet P).

In the above embodiment, the humidifying belts 231, 231 define three conveying paths H1 to H3. The humidifying belts 231, 231 may define more than three conveying paths by adjusting the pressing force of the pressing rollers 232, 232 at more than three levels.

In the above embodiment, the humidifying belts 231, 231 define a fixed conveying path while holding and conveying the sheet P at Step S17. The humidifying belts 231, 231 may deform the conveying path while holding and conveying the sheet P. In other words, the controller 160 may control the second driver 232*c* to curve the humidifying belts 231, 231 to deform the conveying path while the humidifying belts 231, 231 are holding and conveying the sheet P.

In the above embodiment, the drying unit includes the fans 236, 236. The drying unit may include any other device for drying the sheet P such as a heater heating and drying the sheet P, for example.

The entire disclosure of Japanese Patent Application No. 2015-003122 filed on Jan. 9, 2015 is incorporated herein by reference in its entirety.

What is claimed is:

1. A sheet processing apparatus, comprising:

a pair of belts defining a conveying path for holding and conveying a paper sheet;

a water supplying unit which supplies water to outer surfaces of the belts;

a curving unit which curves the conveying path defined by the belts; and a controller which makes the water supplying unit supply water to the outer surfaces of the belts, and makes the belts convey the sheet between the belts in a state where the conveying path is curved by the curving unit to correct the curling of the sheet, wherein the controller determines amounts of water to be supplied respectively to the front side and back side of the sheet, and makes the water supplying unit supply the determined amounts of water to the outer surfaces of the belts which respectively correspond to the front side and back side of the sheet.

2. The sheet processing apparatus according to claim 1, wherein the controller determines the amounts of water to be supplied to the front side and back side of the sheet based on sheet conditions including a sheet type and a coverage rate.

3. The sheet processing apparatus according to claim 1, wherein the controller determines the amounts of water to be supplied respectively to the front side and back side of the sheet based on coverage rates of the front side and back side of the sheet.

4. The sheet processing apparatus according to claim 1, wherein the water supplying unit includes water supplying rollers which are respectively in contact with the belts, and the controller adjusts a pressing force of the water supplying rollers to be applied to the belts to adjust the amounts of water to be supplied to the belts.

5. The sheet processing apparatus according to claim 1, further comprising a drying unit for removing the moisture of the sheet, the drying unit being disposed downstream of and in the vicinity of the belts.

6. An image forming system, comprising:

an image forming apparatus which forms an image on a paper sheet; and the sheet processing apparatus according to claim 1, the sheet processing apparatus conveying the sheet having the image thereon which is formed by the image forming apparatus and thereby correcting the curling of the sheet.

7. A sheet processing apparatus, comprising:

a pair of belts defining a conveying path for holding and conveying a paper sheet;

a water supplying unit which supplies water to outer surfaces of the belts;

a curving unit which curves the conveying path defined by the belts; and a controller which makes the water supplying unit supply water to the outer surfaces of the belts, and makes the belts convey the sheet between the belts in a state where the conveying path is curved by the curving unit to correct the curling of the sheet, wherein the controller determines amounts of water to be supplied respectively to the front side and back side of the sheet based on coverage rates of the front side and back side of the sheet.

8. The sheet processing apparatus according to claim 7, wherein the controller determines the amounts of water to be supplied to the front side and back side of the sheet based on sheet conditions including a sheet type.

9. The sheet processing apparatus according to claim 7, wherein the water supplying unit includes water supplying rollers which are respectively in contact with the belts, and the controller adjusts a pressing force of the water supplying rollers to be applied to the belts to adjust the amounts of water to be supplied to the belts.

10. The sheet processing apparatus according to claim 7, further comprising a drying unit for removing the moisture of the sheet, the drying unit being disposed downstream of and in the vicinity of the belts.

11. An image forming system, comprising:

an image forming apparatus which forms an image on a paper sheet; and the sheet processing apparatus according to claim 7, the sheet processing apparatus conveying the sheet having the image thereon which is formed by the image forming apparatus and thereby correcting the curling of the sheet.

* * * * *